US007931399B2

(12) United States Patent
Courvoisier et al.

(10) Patent No.: US 7,931,399 B2
(45) Date of Patent: Apr. 26, 2011

(54) CHRONOGRAPH WATCH

(75) Inventors: Raphaël Courvoisier, Montmollin (CH); Chrystel Gressly, Courfaivre (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 12/035,266

(22) Filed: Feb. 21, 2008

(65) Prior Publication Data

US 2008/0304368 A1 Dec. 11, 2008

(30) Foreign Application Priority Data

Feb. 22, 2007 (EP) ..... 07102874

(51) Int. Cl.
*G04F 7/00* (2006.01)

(52) U.S. Cl. ..... 368/101; 368/106

(58) Field of Classification Search ..... 368/28, 368/37, 77, 101, 102, 103, 104, 105, 106, 368/110, 113
See application file for complete search history.

(56) References Cited

U.S. PATENT DOCUMENTS

| | | | | |
|---|---|---|---|---|
| 3,675,413 A | | 7/1972 | Fluck | |
| 3,982,388 A | * | 9/1976 | Guyot et al. | 368/35 |
| 4,240,249 A | * | 12/1980 | Malkin et al. | 368/28 |
| 6,118,734 A | * | 9/2000 | Ray et al. | 368/37 |
| 2004/0170088 A1 | | 9/2004 | Seyr | |
| 2005/0152225 A1 | * | 7/2005 | Dias | 368/77 |
| 2006/0215498 A1 | | 9/2006 | Meier | |
| 2007/0086276 A1 | * | 4/2007 | Furukawa et al. | 368/80 |

FOREIGN PATENT DOCUMENTS

| | | |
|---|---|---|
| EP | 1 031 896 A1 | 8/2000 |
| EP | 1 498 788 A1 | 1/2005 |
| FR | 2097126 | 3/1972 |

OTHER PUBLICATIONS

European Search Report issued in corresponding application No. EP 07 10 2874, completed Jan. 8, 2008.

* cited by examiner

*Primary Examiner* — Renee Luebke
*Assistant Examiner* — Jason Collins
(74) *Attorney, Agent, or Firm* — Griffin & Szipl, P.C.

(57) ABSTRACT

The invention comprises a chronograph watch including a chronograph mechanism. The chronograph mechanism includes a chronograph train (50), and a counter mechanism (64) kinematically connected to the train (50). The counter mechanism (64) further includes first and second wheel sets (78, 82) respectively provided with first and second display members (36, 38), wherein the first wheel set (78) is angularly positioned using positioning members (86) so as to rotate in steps, and the second wheel set (82) is angularly positioned by the first wheel set (78).

21 Claims, 5 Drawing Sheets

CHRONOGRAPH WATCH

This application claims priority from European Patent Application No. 07102874.0, filed Feb. 22, 2007, the entire disclosure of which is incorporated herein by reference.

FIELD OF THE INVENTION

The present invention relates to the field of horology. More specifically, it concerns a chronograph watch fitted with a to a counter mechanism with an instantaneous digital display.

BACKGROUND OF THE INVENTION

The digital display mode of a measured time interval offers greater reading comfort than the analogue mode, particularly during practice of a sporting activity. Chronograph watches with a digital display are known to those skilled in the art. They generally include a chronograph mechanism including a chronograph train carrying a measured time seconds hand, or chronograph hand, and a counter mechanism with discs. The display of measured time by discs is either of the continuous or instantaneous type. A continuous display means a display created by the slow movement of figures through an aperture, and an instantaneous display means a display by jumps passing from one unit or ten, to the next unit or ten.

An example of a continuous digital display chronograph watch is given in FR Patent Application No. 2 097 126. It concerns a chronograph watch fitted with a measure time seconds hand, a minute indicator disc visible through a first aperture, and an hour indicator disc visible through a second aperture. The energy for driving the discs is provided by the barrel of the basic movement, via a transmission train that can be uncoupled. Driving is continuous such that the energy consumption of the counter mechanism is low. The barrel of the basic movement is thus enough to supply the movement and the chronograph mechanism with energy. However, the continuous display is inconvenient and means that the measured time cannot be read at a glance.

A chronograph watch with an instantaneous digital display is presented in EP Patent No. 1 498 788. Said watch includes a basic movement powered by a first energy source, and a chronograph mechanism provided with a measure time seconds hand, and three indicator discs respectively for the minute units, tens of minutes and hours. Each of the discs is positioned by a jumper spring and the elastic force of the spring has to be overcome at each jump in order to drive it through steps. Consequently, the energy consumption of this mechanism is high and cannot be taken from the energy source of the basic movement. In order to overcome this drawback, the chronograph mechanism has three additional energy sources each powering one indicator disc. This solution considerably increases the complexity and space requirement of the chronograph mechanism, and thereby increases the manufacturing costs.

SUMMARY OF THE INVENTION

It is an object of the present invention to propose a counter mechanism for a chronograph watch with an instantaneous digital display, powered by a barrel provided for the basic movement. The invention therefore concerns a chronograph watch including a chronograph mechanism, including:

a chronograph train, and a counter mechanism kinematically connected to said train, and including first and second wheel sets respectively of first and second display members, said first wheel set being angularly positioned using a positioning member so as to rotate in steps.

According to the invention, said second wheel set is angularly positioned by said first wheel set.

Using the first wheel set to position the second wheel set saves using an elastic positioning member for the second wheel set. The counter mechanism thus arranged does not use much energy and can be driven using the barrel of the basic movement.

BRIEF DESCRIPTION OF THE DRAWINGS

Other features and advantages of the present invention will appear more clearly upon reading the following detailed description of an example embodiment of a chronograph watch according to the invention, this example being given purely by way of non-limiting illustration, with reference to the annexed drawings, in which.

DETAILED DESCRIPTION OF THE ILLUSTRATIVE EMBODIMENTS

Figure 1:
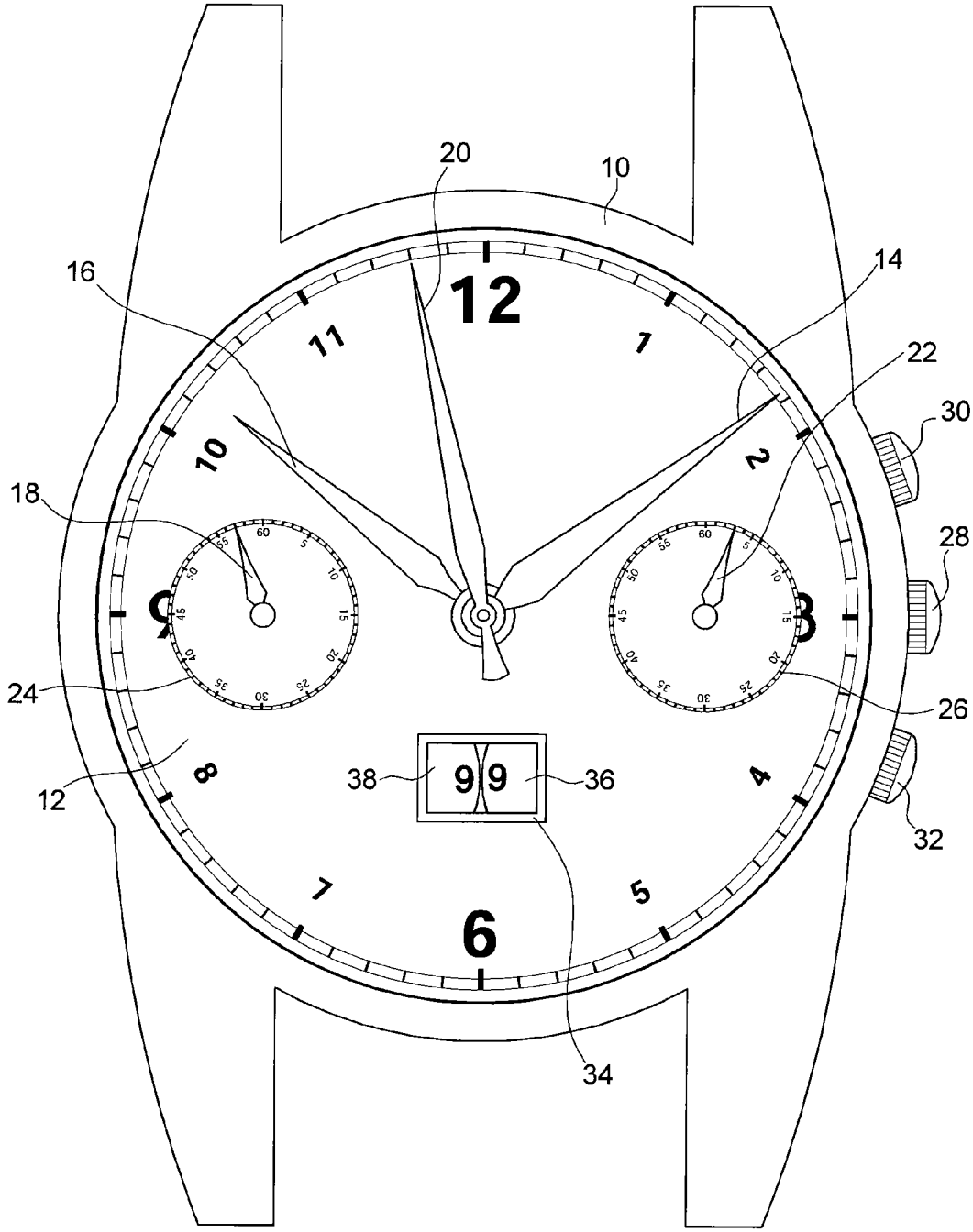
FIG. 1 is a top view of a chronograph watch according to the invention.

The chronograph watch shown in FIG. 1 includes a case 10, which houses a movement (not visible), on which a dial 12 is mounted. The movement carries in a conventional manner minute and hour hands, respectively 14 and 16, a permanent seconds hand 18, a chronograph seconds hand 20 and a chronograph minute hand 22. The permanent seconds hand 18 moves in a first sub-dial 24 located at 9 o'clock, whereas the chronograph minute hand 22 moves in a second sub-dial 26 located at 3 o'clock. The chronograph watch further includes a winding crown 28 and two push buttons 30 and 32 for activating, in a conventional manner, a chronograph control mechanism and a chronograph reset mechanism.

According to the invention, dial 12 includes an aperture 34, located at 6 o'clock, through which two display discs 36 and 38 appear, respectively for the chronograph hour units and tens of hours.

Figure 2:
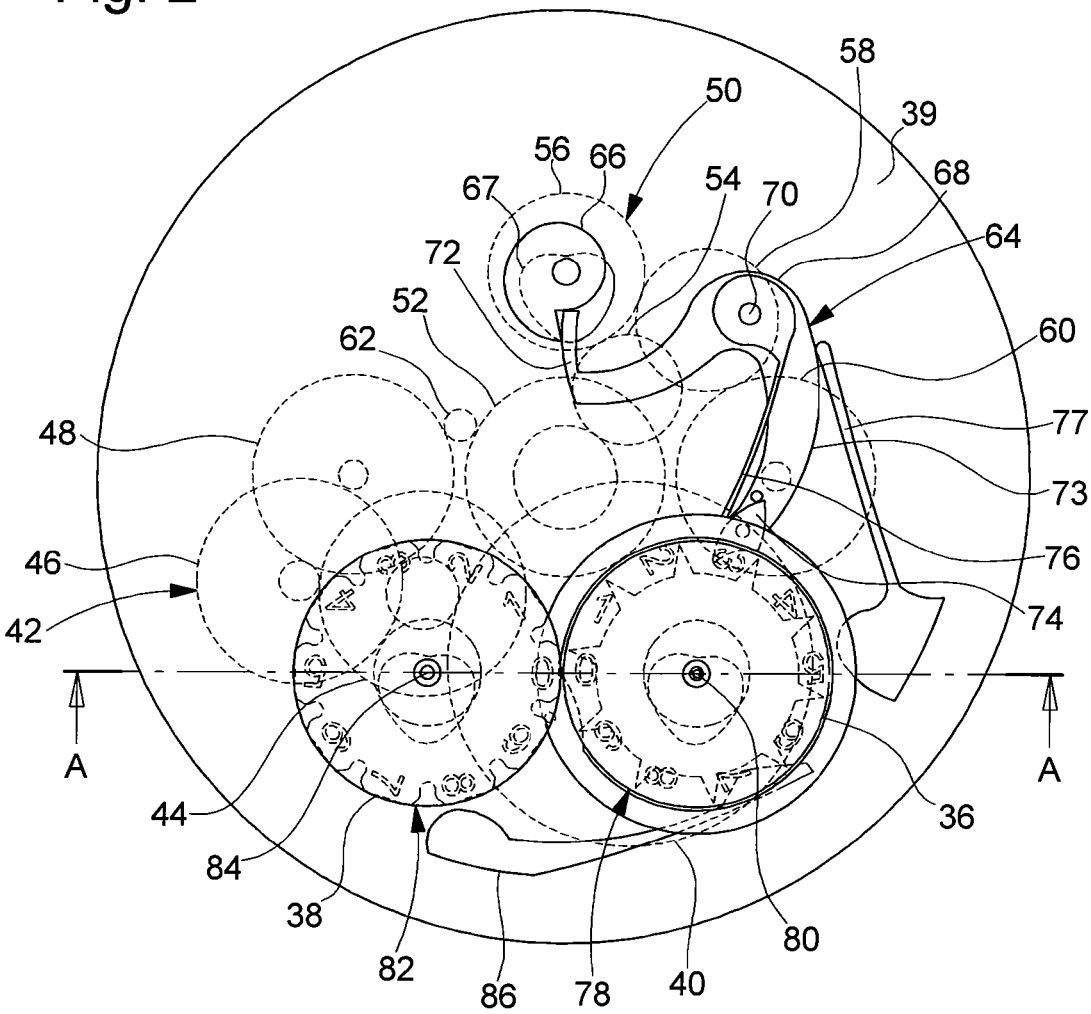
FIG. 2 is a partial schematic view of the movement of this watch.

The movement of the chronograph watch according to the invention is partially visible in FIG. 2. It includes a bottom plate 39 on which there is mounted, on the bridge side, a barrel 40 that powers a going train 42. Said going train 42 includes in a conventional manner a centre wheel set 44 meshed, on the one hand with barrel 40, and on the other hand, with a third wheel set 46, itself meshed with a seconds wheel 48 carrying the permanent seconds hand 18.

The movement also includes, mounted on the bridge side, a chronograph train 50 including a chronograph seconds wheel 52 carrying the chronograph seconds hand 20. The chronograph seconds wheel 52 is meshed with a first intermediate wheel 54, which meshes with an intermediate chronograph minute wheel 56. Said intermediate minute wheel 56 meshes with a second intermediate wheel 58, itself meshed with a chronograph minute wheel 60, carrying the chronograph minute hand 22.

An oscillating pinion 62 acts as the uncoupling member between going train 42 and chronograph train 50. Thus, pinion 62 oscillates between a free position and an uncoupling position in which it kinematically connects the chronograph seconds wheel 52 to the seconds wheel 48. A chronograph control mechanism of conventional type, not shown, causes oscillating pinion 62 to pass from its free position to its uncoupling position, and vice versa, via the action of push button 30.

The movement also includes, mounted on the dial side, a counter mechanism 64 for counting the number of hours of elapsed time and displaying it. The counter mechanism includes a snail shaped cam 66, carried by the intermediate minute wheel 56. A heart-piece 67 is located underneath cam 66, secured to the latter and to the intermediate minute wheel 56. A control lever 68 is pivotably mounted on an arbour 70. It includes a first arm 72 forming a sensor cooperating with cam 66, and a second arm 73 provided with a click 74, positioned using a jumper spring 76. The control lever 68 is held abutting against cam 66 using an elastic member 77. In one direction of rotation and via a click 74, the control lever activates a first display wheel set 78 mounted to rotate freely on an arbour 80, and itself cooperating with a second display wheel set 82 mounted to rotate freely on an arbour 84. The first display wheel set 78 is also positioned using a jumper spring 86.

Figure 4:
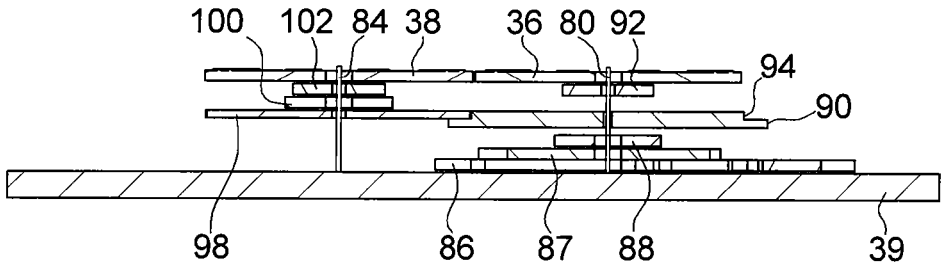
FIGS. 3 and 4 are respectively exploded perspective and cross-sectional views of the counter mechanism of the watch.
Figure 3:
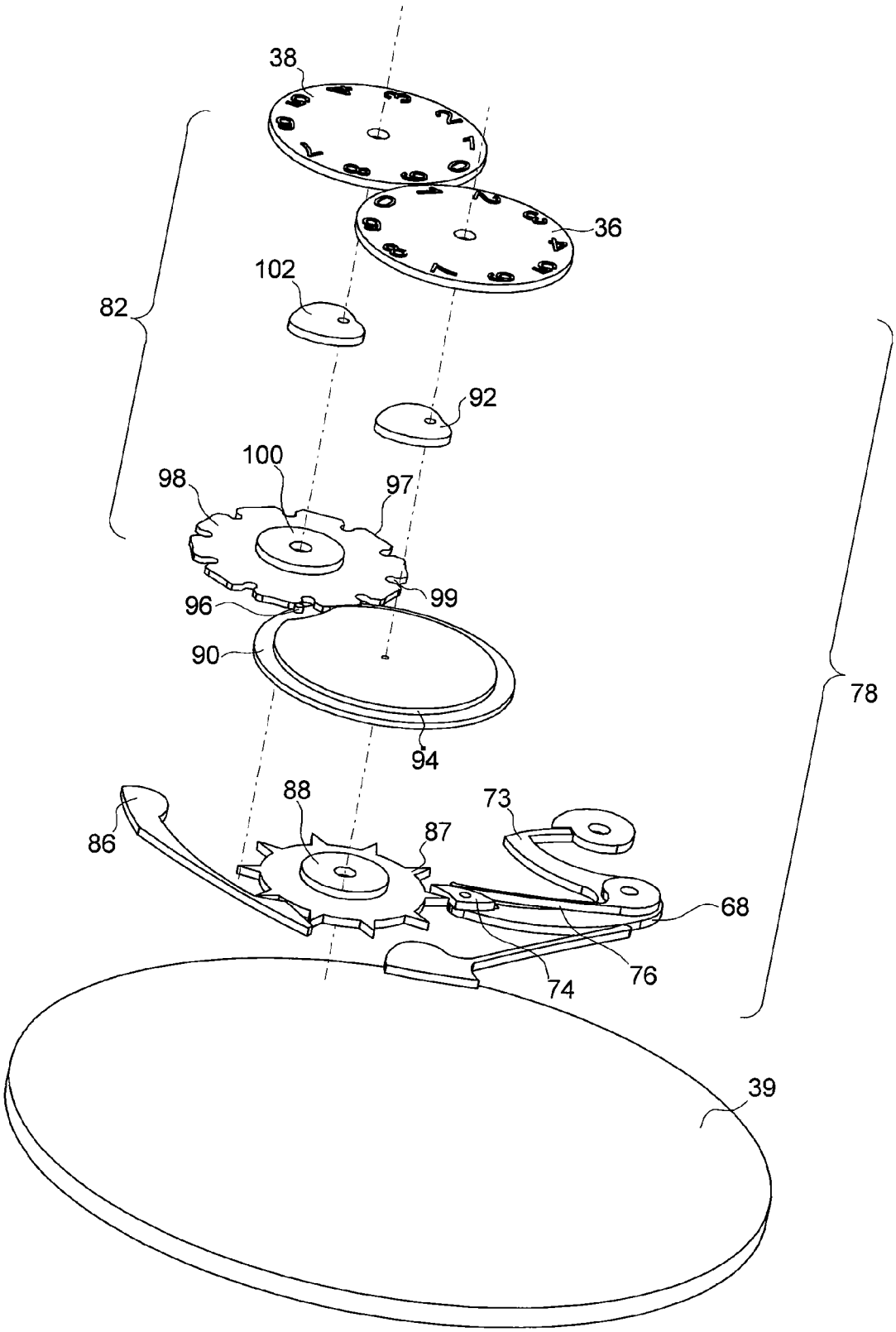

The display wheel set 78 and 82 are shown in detail in FIGS. 3 and 4. Mobile 78 is formed by stacking a star wheel with ten teeth 87, a friction device 88, a stop work finger 90, a heart-piece 92 and finally the hour unit display disc 36. The stop work finger 90 includes in a conventional manner a locking surface 94 forming a portion of a circle and a lug 96. The function of these parts will be explained below. The display disc 36, heart-piece 92 and stop work finger 90 are mounted so as to rotate freely on arbour 80, secured to each other. Star wheel 87 is mounted to rotate freely on arbour 80. It is activated in rotation by control lever 68 and positioned by jumper spring 86. Friction device 88 is chosen such that the friction force between stop work finger 90 and star wheel 87 is less than the positioning force of jumper spring 86.

Wheel set 82 is formed by stacking a Maltese cross 98 with ten branches 97 and ten notches 99, a friction device 100, a heart-piece 102 and the tens of hours display disc 38. Heart-piece 102 and display disc 38 are mounted so as to rotate freely on arbour 84, but they are secured to each other. The Maltese cross 98 is also mounted to rotate freely on arbour 84, at the same height as stop work finger 90, so as to cooperate with locking surface 94 and lug 96. Thus, branches 97 of Maltese cross 98 include in a conventional manner a concave tip, whereas notches 99 are substantially flared. When locking surface 94, or a portion of locking surface 94, is oriented towards the Maltese cross 98, it matches the curvature of the tip of a branch 97, thus blocking Maltese cross 98 in rotation, by the effect of geometry Lug 96 is also arranged to engage in notches 99 when locking surface 94 is released from the tip of branches 97. Lug 96 thus drives Maltese cross 98 in rotation.

Hammers that are not shown are for orientating heart-pieces 92, 102 and 67 via the action of push button 32.

Reference will now be made to FIGS. 5, 6, 7 and 8, which illustrate the operation of the counter mechanism of the chronograph watch of the invention.

Figure 5:
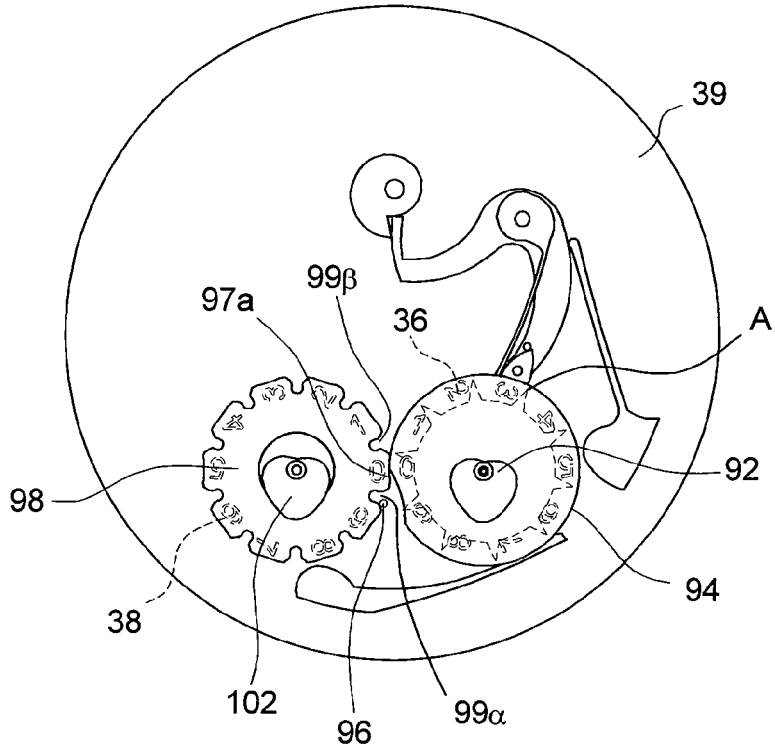
FIGS. 5, 6, 7 and 8 are top views of the counter mechanism in various positions.

When oscillating pinion 62 is in a free position, the chronograph train 50 and counter mechanism 64 are stopped. In the initial position, display discs 36 and 38 display 0 and 0 respectively. Star wheel 87 and Maltese cross 98 can have any angular orientation, since these elements have an order ten symmetry. The same is not true of stop work finger 90. In the initial position, a first end of locking surface 94 cooperates with one branch 97 of Maltese cross 98 referenced 97*a*, framed, in the clockwise and anticlockwise direction by the notches respectively referenced 99α and 99β. Lug 96 is located opposite notch 99*a*. Moreover, cam 66 is orientated such that sensor 72 abuts against the smallest radius of snail 66. Chronograph minute hand 22 then displays 0. FIG. 5 illustrates the initial position.

Figure 6:
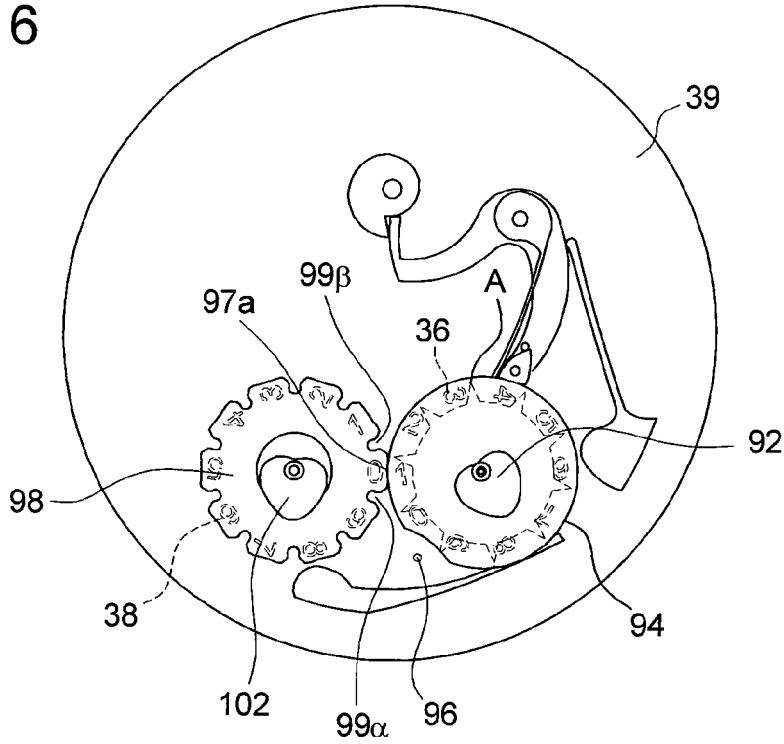

When oscillating pinion 62 is in the coupled position, chronograph seconds wheel 52 rotates at an angular velocity of one revolution per minute, and intermediate minute wheel 55 and chronograph minute wheel 60 rotate at the angular velocity of one revolution per hour. Cam 66, mounted on intermediate minute wheel 56, rotates at the angular velocity of one revolution per hour clockwise. The increase in radius of cam 66 causes control lever 68 to pivot slowly about its arbour 70, in the anticlockwise direction. The pivoting of lever 68 does not drive star wheel 87 in rotation, because of the combined action of click 74, which retracts a tooth referenced "A" and of jumper spring 86. When one hour has elapsed, control lever 68 abruptly tips because of the abrupt change in radius of cam 66. The tipping of control lever 68, in the clockwise direction, drives star wheel 87 through one step, via the action of click 74 on the tooth referenced "A". The whole of wheel set 78 is driven in rotation through one step owing to friction device 88, and display disc 36 now displays 1. FIG. 6 illustrates this position.

Figure 7:
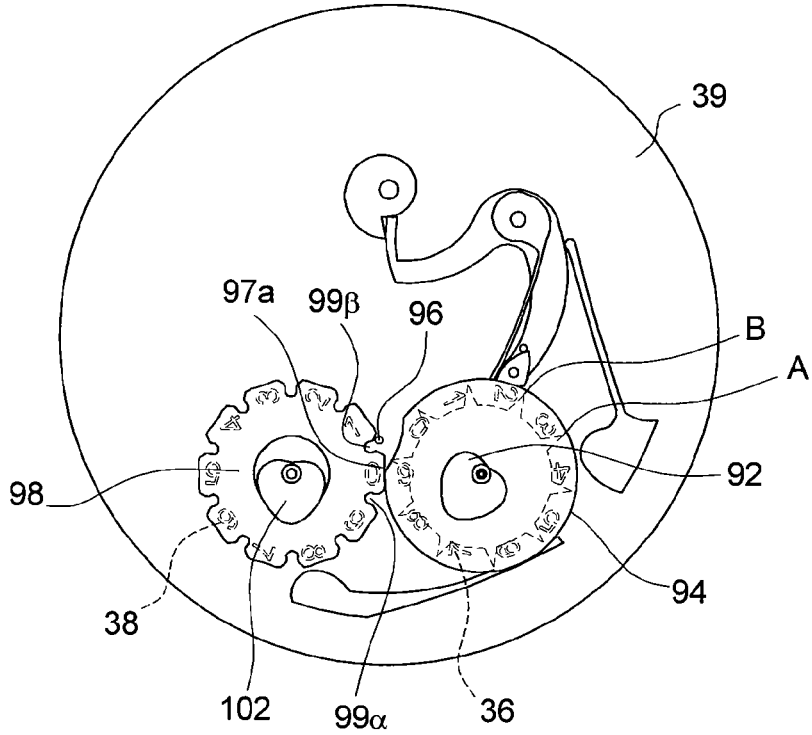
Figure 8:
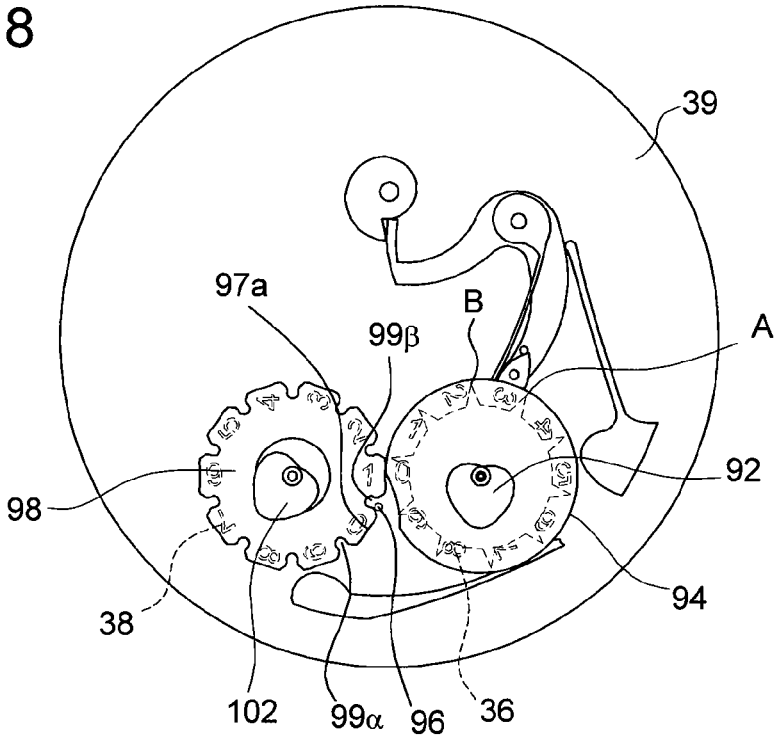

While oscillating pinion 62 is in the coupled position, wheel set 78 rotates at the rate of one step per hour. When 9 hours have passed, the orientation of wheel set 78 relative to wheel set 82 is illustrated by FIG. 7. The second end of locking surface 94 cooperates with branch 97*a* of Maltese cross 98, and lug 86 is located opposite notch 99β, ready to engage therein. At the end of the tenth hour of elapsed time, control lever 68 drives mobile 78 through one step via a tooth referenced "B", next to the tooth referenced "A". Lug 96 engages in notch 9913 and drives wheel set 82 through one step in rotation. The counter mechanism then displays 10, as illustrated in FIG. 8.

It will be noted that the counter mechanism 64 thus described is particularly economical in terms of energy. Indeed, only the hour unit wheel set 78 is positioned using an elastic member, the tens of hours mobile 82 being positioned by the effect of geometry. Consequently, the control lever 68 only has to overcome the elastic force of jumpers spring 86 in order to drive in rotation wheel set 78, and wheel set 82 during passage from one set of tens of hours to the next set of tens. Moreover, the energy taken from barrel 40 to overcome this elastic force, is taken continuously during the time interval necessary for cam 66 to complete one revolution, i.e. one hour. Consequently, the power consumed by the counter mechanism 64 is practically constant and low and does not exceed the maximum power provided by barrel 40.

The counter mechanism 64, thus described, is reset to zero via hammers that are not shown, for orientating heart-pieces 82, 102 and 67.

Heart-piece 67 is secured to cam 66. It is orientated so as to position cam 66 relative to control lever 68, such that sensor 72 rests on the smallest diameter of cam 66. The orientation of cam 66 resets hands 20, 22, respectively for the chronograph seconds and minutes, to zero.

Heart-piece 92 is secured to stop work finger 90 and display member 36, whereas heart-piece 102 is secured to display member 38. When the hammers are activated by push button 32, the assembly of heart-piece 102—display member 38 is orientated angularly, independently of the Maltese cross 98, which is blocked by locking surface 94. The uncoupling between the assembly of heart-piece 102—display member 38 is achieved by friction device 100. Likewise the assembly of stop work finger 90—heart-piece 92—display member 36 is angularly orientated independently of star wheel 87, owing to the combined action of friction device 88 and jumper wheel 86. The use of friction device 88, which detaches star wheel 87 from the rest of mobiles 78 and 82 means that no uncoupling system has to be provided for control lever 66 for zero reset. Counter mechanism 64 thus saves space and gains in simplicity.

It will be noted that when stop work finger 90 is orientated it may, in some configurations, drive Maltese cross 98 in rotation. This has no influence on resetting display member 38 to zero, since friction device 100 detaches Maltese cross 98 from display member 38. Moreover, the final orientation of Maltese cross 98 is of no importance.

Thus, a chronograph watch with an instantaneous digital display has been presented, whose counter mechanism is powered by the going train barrel.

It goes without saying that the present invention is not limited to the embodiment that has just been described, and that various simple alterations and variants could be envisaged by those skilled in the art without departing from the scope of the present invention as defined by the annexed claims. It will be noted, in particular, that the counter mechanism of the watch according to the invention counts the hours and tens of hours. In this particularly advantageous embodiment, the counter mechanism can measure a time interval of up to 100 hours, which is considerable for a mechanical chronograph. In a variant of this embodiment, the counter mechanism could count the minutes and tens of minutes.

What is claimed is:

1. A chronograph watch including a barrel provided for a basic movement, a control mechanism and push buttons operable to activate the control mechanism, and a chronograph mechanism, the chronograph mechanism including:

(a) a chronograph train kinematically connected to the control mechanism; and (b) a counter mechanism powered by the barrel and kinematically connected to the chronograph train, wherein the counter mechanism includes a first wheel set provided with a first display member and a second wheel set provided with a second display member, wherein the first wheel set is angularly positioned using positioning means so as to rotate in steps, wherein the second wheel set is angularly positioned by the first wheel set, and wherein the second wheel set is angularly positioned and driven by the first wheel set only by the effect of geometry, without using an elastic positioning member.

2. The chronograph watch according to claim 1, wherein said second wheel set includes a Maltese cross provided with branches, and wherein said first wheel set includes a locking surface forming a portion of a circle cooperating with said branches of the Maltese cross so as to block said cross angularly.

3. The chronograph watch according to claim 2, wherein said Maltese cross further includes notches, and wherein said first wheel set includes a lug for engaging in said notches so as to drive said second wheel set in rotation.

4. The chronograph watch according to claim 3, wherein said lug forms, with said locking surface, a stop work finger secured to said first display member in rotation.

5. The chronograph watch according to claim 4, wherein said first wheel set further includes a heart-piece secured in rotation to said stop work finger and to said first display member.

6. The chronograph watch according to claim 2, wherein said second wheel set includes a heart-piece secured in rotation to said second display member and a friction device inserted between said heart-piece and said Maltese cross.

7. The chronograph watch according to claim 1, wherein said first wheel set is also arranged for driving said second wheel set in rotation.

8. The chronograph watch according to claim 7, wherein said second wheel set includes a Maltese cross provided with branches, and wherein said first wheel set includes a locking surface forming a portion of a circle cooperating with said branches of the Maltese cross so as to block said cross angularly, wherein said Maltese cross further includes notches, and wherein said first wheel set includes a lug for engaging in said notches so as to drive said second wheel set in rotation.

9. The chronograph watch according to claim 1, wherein said counter mechanism further includes a control mechanism arranged for driving said first wheel set through one step at the end of a given time unit.

10. The chronograph watch according to claim 9, wherein said control mechanism includes a lever cooperating with a cam mounted on the chronograph train so as to complete one revolution during said time unit, said lever being arranged to take, via said cam, substantially constant and not zero power during said time unit, and to deliver said power to said first wheel set at the end of said time unit.

11. The chronograph watch according to claim 10, wherein said lever includes a first branch forming a sensor cooperating with said cam and a second branch provided with a click cooperating with said first wheel set.

12. The chronograph watch according to claim 11, wherein said first wheel set includes a star wheel provided with branches cooperating with said lever and positioned using said positioning means.

13. The chronograph watch according to claim 10, wherein said first wheel set includes a star wheel provided with branches cooperating with said lever and positioned using said positioning means.

14. The chronograph watch according to claim 13, wherein said positioning means are formed by an elastic member.

15. The chronograph watch according to claim 13, wherein said first wheel set includes a stop work finger secured to said first display member in rotation, wherein said first wheel set includes a friction device inserted between said star wheel and said stop work finger.

16. The chronograph watch according to claim 1, wherein said first and second display members are discs respectively relating to time units and tens of time units.

17. The chronograph watch according to claim 16, wherein said time units are in hours.

18. The chronograph watch according to claim 1, further including a going train powered by the barrel, and wherein said chronograph train is kinematically connected to the barrel via an uncoupling member.

19. The chronograph watch according to claim 1, wherein said first display member relates to hour units, and said second display member relates to tens of hour units.

20. A chronograph watch including a barrel provided for a basic movement, a control mechanism and push buttons operable to activate the control mechanism, and a chronograph mechanism, the chronograph mechanism including:

(a) a chronograph train kinemetically connected to the control mechanism; and (b) a counter mechanism powered by the barrel and kinematically connected to the chronograph train, wherein the counter mechanism includes a first wheel set provided with a first display member and a second wheel set provided with a second display member, wherein the second wheel set includes a Maltese cross and the first wheel set includes a lug disposed to drive the Maltese cross in rotation, wherein the first wheel set is angularly positioned using positioning means so as to rotate in steps, wherein rotation of the first wheel set causes the lug to drive the Maltese cross in rotation so that the second wheel set is angularly positioned by the first wheel set, and wherein the first display member is coaxial with the first wheel set and the second display member is coaxial with the Maltese cross of the second wheel set.

21. The chronograph watch according to claim 1, further including a going train powered by the barrel, wherein the going train includes a seconds wheel carrying a seconds hand and the chronograph train includes a chronograph seconds wheel carrying a chronograph seconds hand, and wherein an uncoupling member oscillates between a free position and an uncoupling position in which the uncoupling member kinematically connects the chronograph seconds wheel to the seconds wheel.

* * * * *